US011191330B1

(12) United States Patent
Guins

(10) Patent No.: US 11,191,330 B1
(45) Date of Patent: Dec. 7, 2021

(54) WALLET

(71) Applicant: Jerroll Guins, Accokeek, MD (US)

(72) Inventor: Jerroll Guins, Accokeek, MD (US)

( * ) Notice: Subject to any disclaimer, the term of this patent is extended or adjusted under 35 U.S.C. 154(b) by 353 days.

(21) Appl. No.: 16/244,313

(22) Filed: Jan. 10, 2019

(51) Int. Cl.
*A45C 1/06* (2006.01)
*A45C 13/02* (2006.01)

(52) U.S. Cl.
CPC ..... *A45C 1/06* (2013.01); *A45C 13/023* (2013.01); *A45C 2001/065* (2013.01)

(58) Field of Classification Search
CPC ..... A45C 1/06; A45C 13/023
See application file for complete search history.

(56) References Cited

U.S. PATENT DOCUMENTS 1,749,020 A * 3/1930 Curry ..... A45C 1/06 150/140
4,784,199 A * 11/1988 Wise ..... A45C 1/08 150/134
5,815,845 A * 10/1998 Ault ..... A45C 13/185 2/249
8,567,460 B1 * 10/2013 Lentsch ..... A45C 11/182 150/147
2017/0265610 A1 * 9/2017 Smith, II ..... B29C 51/08

* cited by examiner

*Primary Examiner* — John K Fristoe, Jr.
*Assistant Examiner* — Justin Caudill
(74) *Attorney, Agent, or Firm* — Sanchelima & Associates, P.A.; Christian Sanchelima; Jesus Sanchelima

(57) ABSTRACT

The present invention is a wallet for storing and providing quick access to user desired items therein. The wallet includes a body folded back upon itself along generally parallel bend lines to define a first portion and a second portion therein. The wallet also includes a snap fastening arrangement to secure the first portion and the second portion together to dispose the wallet in a closed state thereof. The wallet further includes one or more sections formed in at least one of the first portion and the second portion such that at least some of one or more sections are accessible when the wallet is disposed in the closed state.

6 Claims, 3 Drawing Sheets

WALLET

BACKGROUND OF THE INVENTION

1. Field of the Invention

The present disclosure generally relates to means for carrying multiple payment devices, like the currency, checks and credit cards; and particularly, to a wallet which allows to carry and organize such payment devices, and portray a fashion statement when being by a user.

2. Description of the Related Art

With wider choices of payment options available, it becomes increasingly desirable to organize the currency, checks and multiple number of credit cards, associated with the payment options into a wallet or similar object that can be conveniently carried in a person's clothing. For example, people are often forced to carry numerous credit cards that are each used only for particular purposes such as business or personal purchases. Additionally, it is desirable for people to carry alternative payment devices because not all vendors accept a particular type of payment device. So, it becomes necessary to have a wallet which can provide multiple pockets to carry such large number of items.

However, wallets don't provide any easy look inside and/or quick access to items therein. For example, if the user has to pull out a credit card from the wallet, for example, for making a payment at a counter; in such case, the user may have to first open/unlock the wallet to access the card, which is slightly cumbersome. Moreover, traditionally, wallets or billfolds have been designed to be utilitarian. Even most of the designer wallets have generally rectangular shapes. These traditional designs have not changed over decades, if not centuries. However, it is desirable for a user that his/her the wallet portray a desired style statement when being carried around.

Therefore, there is a need to provide a wallet which is stylish, provide quick access to items therein. Documents describing the closest subject matter provide for a number of more or less complicated features that fail to solve the problems described above in an efficient and economical way. None of the documents suggest the novel features of the present invention.

SUMMARY OF THE INVENTION

It is one of the main objectives of the present invention to provide a wallet which include a number of pockets for cards, tickets, coins and the like, all of which can be easily accessed and extracted when needed.

It is another objective of the present invention to provide a wallet in which credit card or the like can be slid into from either one of its side or can be put into the holder by spreading apart the top.

It is yet another objective of the present invention to provide a wallet which provides quick access so that a credit card or the like can be removed for use therefrom without the necessity of entirely opening the wallet.

It is still another objective of the present invention to provide a wallet which is stylish to use, and relatively easy and inexpensive to manufacture.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Illustrative embodiments of the present invention are described below. The following explanation provides specific details for a thorough understanding of and enabling description for these embodiments. One skilled in the art will understand that the invention may be practiced without such details. In some instances, well-known structures, processes and functions have not been shown or described in detail to avoid unnecessarily obscuring the description of the embodiments.

It shall be noted that unless the context clearly requires otherwise, throughout the description, the words "comprise," "comprising," "include," "including," and the like are to be construed in an inclusive sense as opposed to an exclusive or exhaustive sense; that is to say, in the sense of "including, but not limited to." Words using the singular or plural number also include the plural or singular number, respectively while adhering to the concepts of the present invention. Furthermore, references to "one embodiment" and "an embodiment" are not intended to be interpreted as excluding the existence of additional embodiments that also incorporate the recited features.

Figure 1:
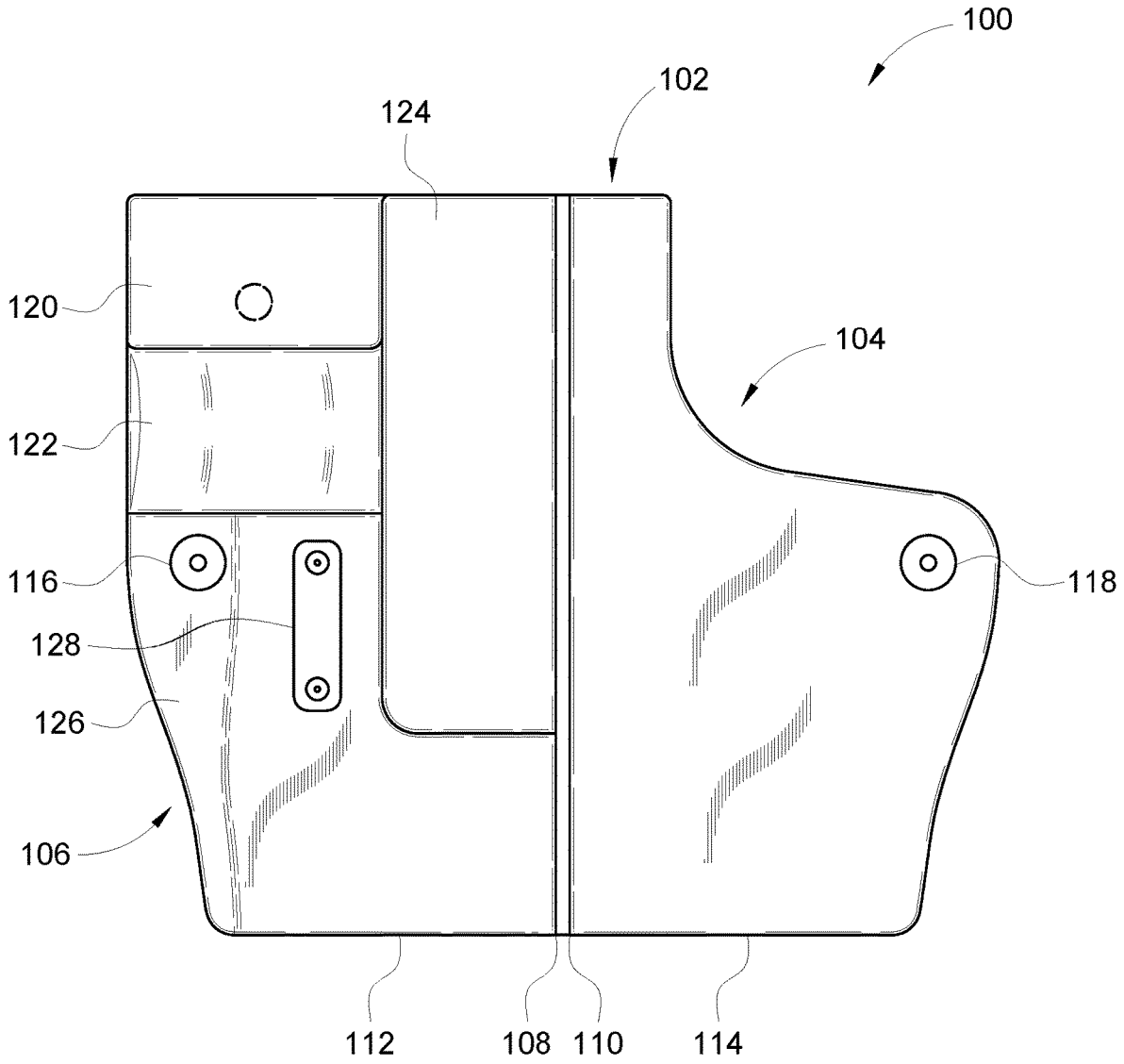
FIG. 1 illustrates a diagrammatic front view of a wallet 100 in open state thereof, in accordance with one or more embodiments of the present invention.
Figure 2:
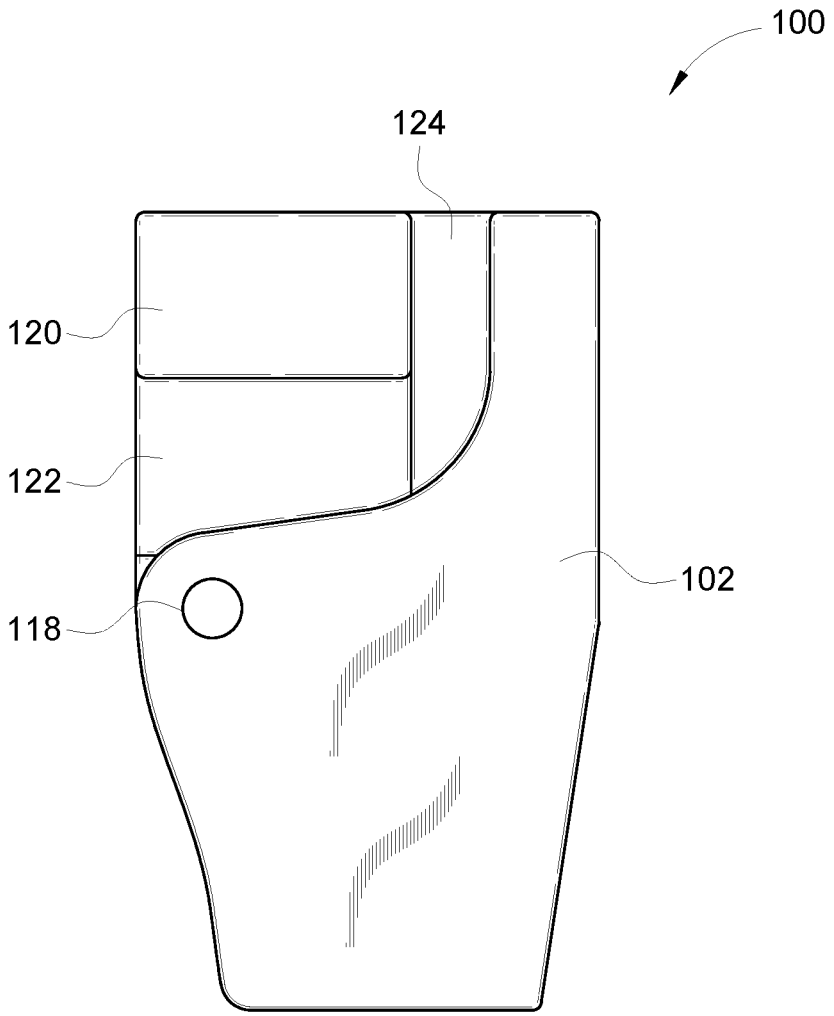
FIG. 2 illustrates a diagrammatic front view of the wallet 100 in closed state thereof, in accordance with one or more embodiments of the present invention.

Referring to the drawings, FIGS. 1-2 illustrates diagrammatic views of a wallet (generally designated by the numeral 100) in an open state and a closed state thereof respectively, in accordance with embodiments of the present disclosure. The present wallet 100 is a billfold type wallet which can be used to carry multiple items, especially payment devices like cash bills, checks, and cards like payment cards. For the purpose of the present disclosure, the term "payment card" may include any payment or authentication purposes cards, like "credit card", "debit card", "loyalty cards", "membership cards", etc. without any limitations. The present wallet 100 can also be used for carrying accessories like sunglasses, as discussed in the subsequent paragraphs.

As illustrated, the wallet 100 includes a generally rectangular body 102 with a section 104 cut-off therefrom. The body 102 may generally be shaped to be longer along transverse direction compared to longitudinal direction thereof, thereby providing the wallet a taller appearance. The section 104 that is cut-off may be generally circular or arc shaped, and may be disposed along one of the four corners of the body 102. In some examples, as illustrated in FIG. 1, the diametrically opposing corner of the body 102 may also be provided with a section, such as section 106, which may be shaped as, for example, a subtle arc with much larger radius of curvature for providing a distinct style to the wallet 100.

For the present wallet 100, the body 102 may be made of suitable materials for the wallet 100 to be implemented as a fashion accessory. In an example, the body 102 may be fabricated of leather material or imitation leather. In another example, the body 102 may be fabricated of some other premium materials, such as high-stiffness fabrics or the like. The wallet 100 may be fabricated such that there are no stitched or glued seams visible in the body 102. In some examples, the body 102 may be made of a thin sheet of aluminum, or alternatively a thin sheet of aluminum may be embedded between two layers of leather or some other premium material, in order to provide the anti-scanning security of aluminum by blocking scanning of magnetic strips, or RFID tags associated with payment cards.

In the present embodiments, as illustrated better in FIG. 1, the body 102 (in the form of planar sheet) is folded back upon itself along generally parallel bend lines 108 and 110. The bend lines 108 and 110 may be formed substantially at a center along the longitudinal direction of the body 102. The bend lines 108 and 110 thus divide the body 102 into two sections, namely a first portion 112 and a second portion 114. It may be appreciated that the body 102 may be folded about the parallel bend lines 108 and 110 to place the second portion 114 over the first portion 112, thereby disposing the wallet 100 in the closed state (as depicted in FIG. 2) from the open state (as depicted in FIG. 1). In some examples, the body 102 as being folded transversely may alternatively or further be folded longitudinally for reducing its size for convenience in carrying thereof in a small pocket, without departing from the scope of the present disclosure.

In the present embodiments, as illustrated better in FIG. 1, the wallet 100 is provided with locking means for securing the first portion 112 and the second portion 114 together, when the wallet 100 is disposed in the closed state. In the illustrated embodiment, the wallet 100 is shown to include a snap fastening arrangement using snap fastener (also called press stud, popper, snap or tich) for securing the first portion 112 and the second portion 114 together. Herein, the snap fastening arrangement may include a female part 116 (i.e. a receiving button) arranged on the first portion 112 of the body 102 and a male part 118 (i.e. a pushing button) arranged on the second portion 114 of the body 102. The parts 116 and 118 are aligned in a manner such that when the second portion 114 is folded over the first portion 112, the male part 118 is placed directly above the female part 116, and thereby a protruding portion of the male part 118 be pushed into a groove of the female part 116 to lock the snap fastening arrangement, and this securing the first portion 112 and the second portion 114 together to dispose the wallet 100 in the closed state. It will be appreciated that the female part 116 and the male part 118 may be disposed along a horizontal line parallel to one of a top side or a bottom side of the body 102 of the wallet 100.

The wallet 100 may include various pockets and/or sections that may be formed or coupled with the body 102 thereof. Generally, these sections/pockets may be formed in an inner side (as shown in FIG. 1) of the first portion 112 of the body 102. In one or more embodiments, as illustrated in FIG. 1, the wallet 100 may have a first section 120 which may be provided with a pocket implemented for holding payment cards or the like. In some examples, the first section 120 may be provided with a closure arrangement (not shown), such as a cover, to secure the payment card when placed in the first section 120 and prevent accidental removal thereof. In some examples, the first section 120 may be provided with multiple layers of pockets for holding more than one payment cards therein without any limitations. In an example, the first section 120 may be accessed from the top side of the body 102 to insert the payment card or the like therein. Further, the wallet 100 may include a second section 122 which may be located directly below the first section 120 in the body 102. The second section 122 may be provided with a pocket implemented for storing cash and/or more payment cards therein. In an example, the second section 122 may be accessed from a side, such as a left side of the body 102, to insert the payment card or the like therein. It may be seen that the second section 122 with the pocket may be raised with respect to the plane of the first portion 112 to form the pocket therein.

In one or more examples, the wallet 100 may also include a third section 124 which may be generally extending along the transverse direction of the body 102 with a small width in the longitudinal direction thereof. A pocket may be provided in the third section 124 to provide space for storing accessories, such as sunglasses or the like, of the user in the present wallet 100. The first portion 112 may further include a fourth section 126 made of semi-hard material and may further be raised with repast to the plane of the first portion 112. In one example, the fourth section 126 may include a loop 128 formed therein, which may be suitable for holding keys, like car keys, or the like. Optionally, the fourth section 126 may be provided with one or more pockets, or for example a small mirror or the like, for providing additional storage or functionality to the user using the wallet 100 of the present disclosure. In some examples, an inner side (as shown in FIG. 1) of the second portion 114 may also be provided with pockets to store other payment devices or accessories of the user without any limitations. In other examples, an outer side (as shown in FIG. 2) of the first portion 112 and/or the second portion 114 of the body 102 may also be provided with pockets to store other payment devices or accessories of the user without any limitations.

As illustrated in FIG. 2, the wallet 100 when disposed in the closed state is generally shaped like a holster. It may be seen that even when the wallet 100 is disposed in the closed state, the first section 122 and the second section 124 of the wallet 100 are still accessible. This allows a user of the wallet 100 to have quick and convenient access to the payment card, for example a frequently used payment card stored in the pocket of the first section 122 and/or the second section 124, while the wallet 100 is in the closed state. Therefore, the user can simply pull out the wallet 100, say from a pocket of a trouser thereof, and slide out the payment card from the first section 122 and/or the second section 124, for example, by spreading apart the top side of the body 102, for making payment without the hassle of opening of the wallet 100 each time, i.e. disposing the wallet 100 in the open state thereof. Similarly, the payment card (i.e. credit card or the like) can be slid back into the pocket of the first section 122 and/or the second section 124, and thereby safely stored into the wallet 100 without the necessity of entirely opening the wallet. In some example, the third section 126, and thereby the accessories stored in the pocket(s) therein, may also be made accessible for the user while the wallet 100 is in the closed state for providing easy access thereto.

Figure 3:
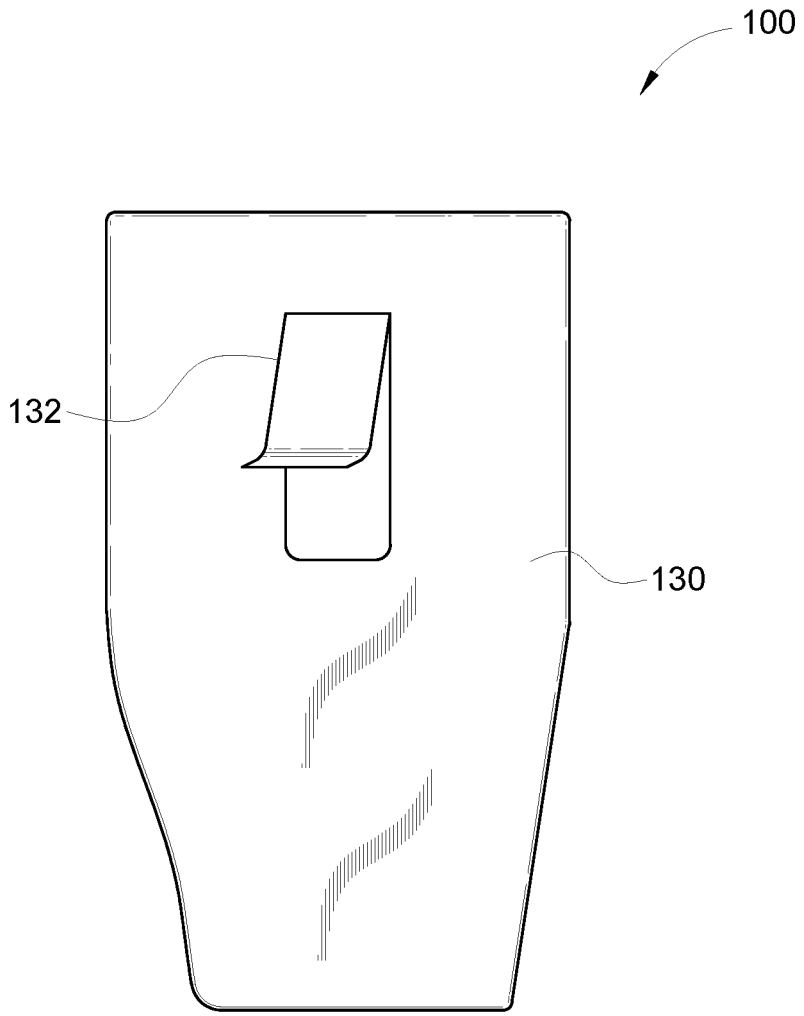
FIG. 3 illustrates a diagrammatic back view of the wallet 100, in accordance with one or more embodiments of the present invention.

FIG. 3 illustrates a back view of the wallet 100, or specifically a back view of the second portion 114 thereof. Herein, a back portion 130 of the wallet 100 may be made of same materials as the first and second portions 112 and 114 in the front. Alternatively, the back portion 130 may be made of some other materials, or different textures or colors, without any limitations. In an embodiment, the wallet 100 may be provided with a clip 132 arranged on the back portion 130 thereof. The clip 132 may be handy to secure or mount the wallet 100 to a belt or some other accessory being worn by the user for providing convenient means of carriage therefor.

In one or more examples, a gap between the bend lines 108 and 110 may be about 1.5 inches. This allows the wallet 100 to be easily folded along the bend lines, when needed. The wallet 100 may have a total height of about 7.5 inches, with the first section 120 the second section 122 being about 4 inches in height together, and the third section 126 being about 3.5 inches in height. Further, the third section 124 may have a height of about 6 inches. Furthermore, a width of the first portion 112 may be about 5 inches. Herein, a width of the first section 120, and thereby also the second section 122, may be about 3 inches; and a width of the third section 124 may be about 2 inches.

The wallet 100 of the present disclosure provide a safe and convenient means of carrying currency, payment cards and valuable papers. The various pockets on the inner side of the one or more sections may provide storage in which change, postage or small articles of any kind may be carried. These items are protected by folding of the portions 112, 114 when the wallet 100 is disposed in the closed state. The folded over portions 112, 114 keep the items, including the currency bills and credit cards from falling out of the ends of the pockets. The present wallet 100 being simple, minimalist and unique in design (due to its holster shape in closed state) provides functioning of quick and convenient access to payment options while also being stylish in design.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense in any manner.

What is claimed is:

1. A wallet comprising:

a body folded back upon itself along parallel bend lines to define a first portion and a second portion therein, wherein said second portion includes a concave portion that extends from a second portion top edge to a second portion lateral edge, the first portion including a first section being a first rectangular pocket, said first section being located on a top left corner of an interior of the first portion, the first portion further including a second section, the second section being a second rectangular pocket located entirely underneath the first section, the second section including an opening along the first portion lateral edge to provide access therein, the first portion including a third section being a third rectangular pocket with an edge adjacent to said parallel bend lines, the third section being located entirely between the first section and the parallel bend lines;

a snap fastening arrangement to secure the first portion and the second portion together to dispose the wallet in a closed state thereof, the snap fastening arrangement being located entirely below said concave portion and said second section.

2. The wallet of claim 1, wherein the body is made of leather material.

3. The wallet of claim 1, further comprising a clip adapted for securing with an accessory being worn by a user.

4. The wallet of claim 1, wherein the first portion includes a loop mounted therein and configured to receive items such as keys.

5. The wallet of claim 1, wherein said first section and said second section are exposed when the wallet is in a closed configuration.

6. A wallet consisting of:

a) A body folded back upon itself along parallel bend lines to define a first portion and a second portion therein, wherein said second portion includes a concave portion that extends from a second portion top edge to a second portion lateral edge, the first portion including a first section being a first rectangular pocket, said first section being located on a top left corner of an interior of the first portion, the first portion including a loop mounted therein and configured to receive items such as keys the first portion further including a second section, the second section being a second rectangular pocket located entirely underneath the first section, the second section including an opening along the first portion lateral edge to provide access therein, the first portion including a third section being a third rectangular pocket with an edge adjacent to said parallel bend lines, the third section being located entirely between the first section and the parallel bend lines, wherein said first section and said second section are exposed when the wallet is in a closed configuration;

b) A snap fastening arrangement to secure the first portion and the second portion together to dispose the wallet in a closed configuration, said closed configuration exposing the first section and the second section, the snap fastening arrangement being located entirely below said concave portion and said second section.

* * * * *